US008696152B2

(12) United States Patent
Cumberland

(10) Patent No.: US 8,696,152 B2
(45) Date of Patent: Apr. 15, 2014

(54) RENEWABLE ENERGY POWERED LIGHT ASSEMBLY

(76) Inventor: Holly S. Cumberland, Malibu, CA (US)

( * ) Notice: Subject to any disclaimer, the term of this patent is extended or adjusted under 35 U.S.C. 154(b) by 749 days.

(21) Appl. No.: 12/729,125

(22) Filed: Mar. 22, 2010

(65) Prior Publication Data

US 2011/0228520 A1 Sep. 22, 2011

(51) Int. Cl.
*F21S 8/00* (2006.01)

(52) U.S. Cl.
USPC ..... 362/147; 362/183

(58) Field of Classification Search
USPC ..... 362/147, 183
See application file for complete search history.

(56) References Cited

U.S. PATENT DOCUMENTS

| | | | | |
|---|---|---|---|---|
| 4,411,493 | A | 10/1983 | Miller | |
| 4,820,020 | A | 4/1989 | Terrill | |
| 4,883,340 | A | 11/1989 | Dominguez | |
| 5,012,160 | A * | 4/1991 | Dunn Thompson | 313/149 |
| 5,528,471 | A | 6/1996 | Green | |
| D397,233 | S | 8/1998 | Bassford | |
| 5,878,539 | A | 3/1999 | Grubb | |
| 6,178,707 | B1 | 1/2001 | Bengtson | |
| 6,339,188 | B1 | 1/2002 | Voelkner | |
| 6,385,922 | B1 | 5/2002 | Mors | |
| 6,583,573 | B2 | 6/2003 | Bierman | |
| 6,695,692 | B1 | 2/2004 | York | |
| 7,819,545 | B2 * | 10/2010 | Ponamar | 362/183 |
| 2004/0012951 | A1 * | 1/2004 | Pylkki et al. | 362/152 |
| 2006/0007549 | A1 * | 1/2006 | Zincone | 359/591 |
| 2006/0225776 | A1 | 10/2006 | Nemazi et al. | |
| 2009/0237918 | A1 * | 9/2009 | Yang | 362/183 |

* cited by examiner

*Primary Examiner* — Sean Gramling
(74) *Attorney, Agent, or Firm* — Brian B. Shaw, Esq.; Harter Secrest & Emery LLP

(57) ABSTRACT

The invention is a renewable energy powered light assembly for a roof window of a building. A housing extends within the roof aperture from an interior of the house towards the exterior. A plurality of lighting elements is disposed in the housing. A renewable energy source is connected to each of the lighting elements. A solar panel array collects light from an electrical grid powered lighting element. A rechargeable power source is connected to the renewable energy source and the plurality of lighting elements. The invention also is a light assembly for illuminating an area from a floor of a building. A renewable energy source is externally mounted and coupled to a plurality of lighting elements disposed adjacent the floor. A rechargeable power source is coupled to the energy source and the plurality of lighting elements for storing the power generated and powering the plurality of lighting elements.

23 Claims, 4 Drawing Sheets

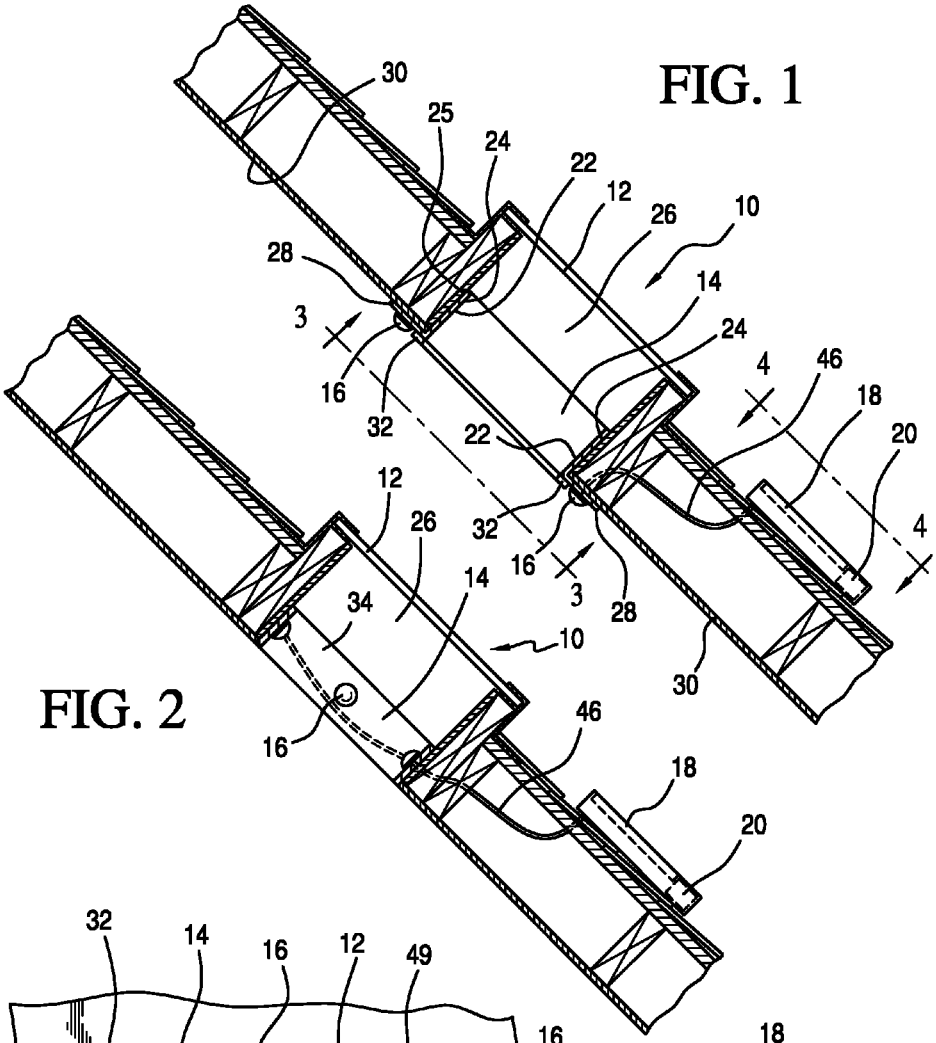
FIG. 1
FIG. 2
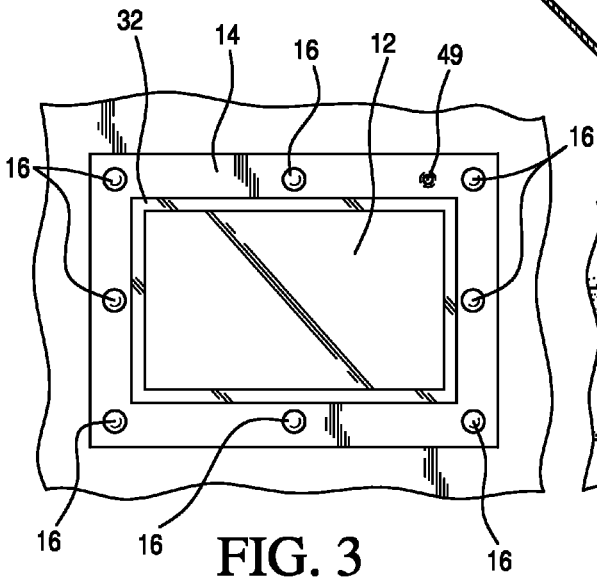
FIG. 3
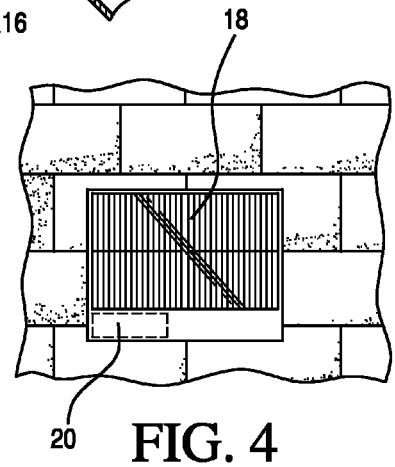
FIG. 4

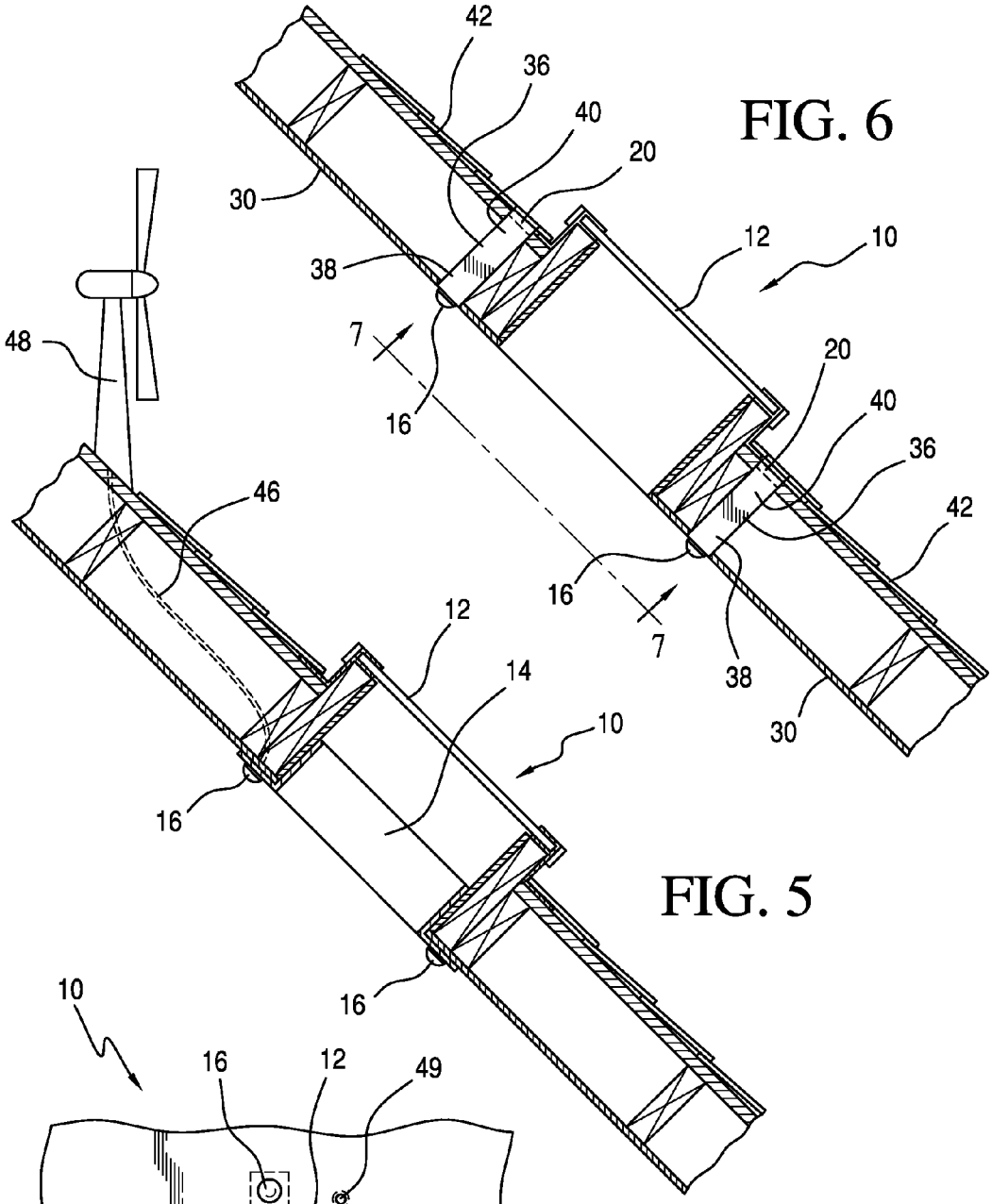
FIG. 6
FIG. 5
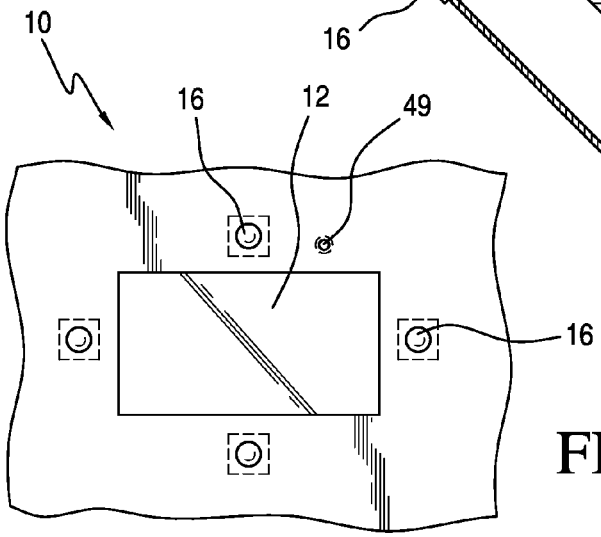
FIG. 7

RENEWABLE ENERGY POWERED LIGHT ASSEMBLY

CROSS-REFERENCE TO RELATED APPLICATIONS

None.

STATEMENT REGARDING FEDERALLY SPONSORED RESEARCH OR DEVELOPMENT

None.

REFERENCE TO A "SEQUENCE LISTING"

Not applicable.

BACKGROUND OF THE INVENTION

1. Field of the Invention

The present invention relates generally to a light assembly and more particularly to a renewable energy powered light assembly for a window or wall of a building.

2. Description of Related Art

Over recent years, there has been volatility in the price of electricity. In addition to price volatility, the use of certain fuels has been found to be harmful to the environment. For example, when electricity is generated from coal, large amounts of carbon dioxide are emitted into the environment, which contributes to poor air quality and global warming. As a result, many are interested in using alternative energy sources which are less expensive and more environmentally friendly. One type of alternative energy source that is becoming increasingly popular is solar power. Solar power is a renewable power source that produces power at a fuel cost of zero and can be used in a variety of settings, including but not limited to residential, municipal and commercial property settings. Another alternative energy source is wind power, wherein wind turbines are used to generate electricity.

A problem with solar and wind power is that there is a significant upfront cost associated with obtaining the equipment and components necessary to utilize a solar or wind powered system. Thus, although many individuals are interested in utilizing renewable energy sources, the upfront expense of switching from the electric power grid to these renewable energy sources is prohibitively expensive. With respect to generating wind power, large wind turbines that are massive and expensive are needed to generate enough electricity to provide enough power for a building.

What is needed then is an off-grid renewable energy powered light assembly that provides low level lighting that can be used to at least partially illuminate a hallway or other area in a building requiring minimal illumination.

A renewable energy powered light assembly that is easy to install and doesn't require a large investment to implement is also needed.

BRIEF SUMMARY OF THE INVENTION

Certain embodiments of the present invention are direct to an off-grid renewable energy powered light assembly for a window in a roof or a wall of a building which and provides one or more benefits and advantages not previously offered in the art, including but not limited providing a low level lighting source. Another advantage of the present invention is that it provides a cheap, low level lighting option for those that do not want to make the initial investment of installing a renewable energy system for a building that replaces power received from the electric grid for all or substantially all appliances, lights and equipment.

In one configuration, the present invention comprises a plurality of housings insertable through the roof and arranged about a perimeter of the window. Each housing has an upper portion disposed outside the building and a lower portion disposed inside the building and a renewable energy powered lighting element disposed in the lower portion of each housing. A renewable energy source is connected to each of the renewable energy powered lighting elements and is disposed on the upper portion of each of the housings for generating power for the renewable energy powered lighting elements. A plurality of rechargeable power sources are each connected to the renewable energy source and the renewable energy powered lighting element of each housing for storing the power generated by the renewable energy source and powering the renewable energy powered lighting element.

The present invention also includes an off-grid solar powered light assembly for a window comprising a plurality of solar powered lighting elements circumscribing a perimeter of the window and spaced at a predetermined distance from each other. At least one solar panel is coupled to the plurality of solar powered lighting elements for collecting light and generating power for the plurality of solar powered lighting elements. A rechargeable power source is coupled to the at least one solar panel and the plurality of solar powered lighting elements for storing the power generated by the solar panel and powering the plurality of solar powered lighting elements.

Another configuration of the invention comprises a solar powered light assembly for a house having a roof aperture with a window therein having a housing extending within the roof aperture from an interior of the house towards the exterior of the house. A solar panel and a solar powered lighting element are each connected to the housing. A rechargeable power source is connected to the solar panel and the solar powered lighting element for storing the power generated by the solar panel and powering the solar powered lighting element.

In another configuration, an off-grid renewable energy powered light assembly for illuminating an area from a floor of a building comprises a plurality of renewable energy powered lighting elements each disposed adjacent the floor, a renewable energy source coupled to the plurality of renewable energy powered lighting elements and externally mounted adjacent the building for generating power for the plurality of renewable energy powered lighting elements. A rechargeable power source is coupled to the renewable energy source and the plurality of renewable energy powered lighting elements for storing the power generated by the renewable energy source and powering the plurality of renewable energy lighting elements.

BRIEF DESCRIPTION OF THE SEVERAL VIEWS OF THE DRAWING(S)

The foregoing features of this invention, as well as the invention itself, may be more fully understood form the following description of the drawings in which:

FIG. 1 is a cross-sectional view of a roof of a building having a skylight and a solar powered light assembly having lighting elements disposed on an L-shaped plate and that circumscribe an outer perimeter of a light shaft of the building.

FIG. 2 is a cross-sectional view of a roof having a skylight and a solar powered light assembly having lighting elements disposed on a collar inserted within a light shaft of the building.

FIG. 3 is a partial top view of a skylight having the solar powered light assembly taken from lines 3-3 of FIG. 1.

FIG. 4 is a partial top view of a solar panel mounted on a roof of a building.

FIG. 5 is a cross-sectional view of a roof having a skylight and a light assembly similar to that shown in FIG. 1, but having a wind turbine for generating wind power.

FIG. 6 is a cross-sectional view of a roof having a skylight and a light assembly having a plurality of housings each housing containing a light element and circumscribing an outer perimeter of the skylight.

FIG. 7 is a partial top view of the skylight taken from lines 7-7 of FIG. 6.

DETAILED DESCRIPTION OF THE INVENTION

Figure 8:
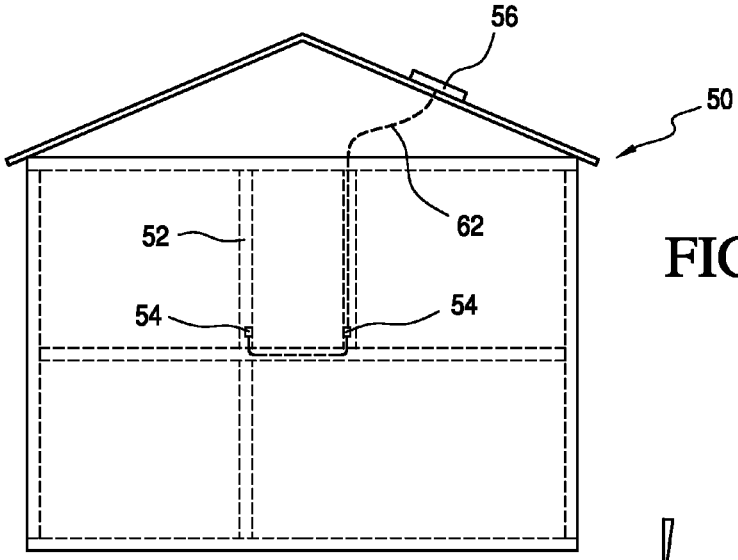
FIG. 8 is a view of a building having a wall mounted light assembly coupled to a solar panel.

At the outset, it should be appreciated that like drawing numbers on different drawing views identify identical structural elements of the invention. While the present invention is described with respect to what is presently considered to be the preferred embodiment, it is understood that the invention is not limited to the disclosed embodiment.

Furthermore, it is understood that the invention is not limited to the particular methodology, materials, and modifications described and as such may vary. It is also understood that the terminology used herein is for the purpose of describing particular elements only, and is not intended to limit the scope of the present invention, which is limited only by the appended claims.

Referring to the Figures, FIGS. 1-6 show a renewably energy powered light assembly 10 for a skylight 12, having a frame or housing 14 including lighting elements 16, a solar panel 18 or a wind turbine 48, and a rechargeable battery 20. The lighting elements 16 are each connected to the renewable energy source, such as the solar panel 18 or the wind turbine 38, and the rechargeable battery 20 to provide a renewable energy powered light assembly.

In one configuration, the frame 14 is an L-shaped plate 22 having an upper portion 24 contiguous a portion of a wall 25 of a light shaft 26 and a lower portion 28 contiguous the ceiling 30 and adjacent the light shaft 26. In this configuration, the lighting elements 16 are mounted on, or within, the lower portion 28 of the L-shaped plate 22. Any suitable material can be used for the L-shaped plate 22, including but not limited to plastic and metal materials. The L-shaped plate 22 can be adhesively secured to the ceiling 30 and the wall 25 of the light shaft 26 by any suitable adhesive. In the alternative or in addition, the L-shaped plate 22 can be secured by other fastening materials, including but not limited to, screws, screws with anchor bolts, nails, clips, and other fasteners known in the art. Preferably, the L-shaped plate 22 includes at least two lighting elements 16 that are spaced a predetermined distance from each other. For example, the lighting elements 16 can be spaced approximately between six inches and thirty-six inches from each other. Preferably, the light assembly 10 includes two to twelve lighting elements 16 spaced at least six inches from each other. Thus, the light assembly 10 can include a plurality of lighting elements 16 that circumscribe the skylight 12 and provides a renewable energy powered light source that can be used instead of, or in addition to, lights in a building powered by the electrical grid.

As shown in FIG. 1, an additional solar panel 32 is mounted along the inner perimeter of the lower portion 28 of the L-shaped plate 22. This solar panel 32 is arranged to collect light from the other lighting elements within the building that are powered by the electrical grid and allow for the additional storage of energy when the other lighting elements in the building are used. It should be appreciated by those having ordinary skill that an additional solar panel 32 can be mounted along the outer perimeter of the lower portion 28 of the L-shaped plate 22 and this modification is intended to be within the scope of the invention as claimed.

In an alternative configuration, as shown in FIG. 2, the frame 14 is a collar 34 disposed within the light shaft 26. In this configuration, the lighting elements 16 are mounted on, or within, the collar 34. Any suitable material can be used for collar 34, including but not limited to plastic and metal materials. The collar 34 can be adhesively secured to the wall 25 of the light shaft 26 by any suitable adhesive and/or secured by other fastening materials, including but not limited to, screws, screws with anchor bolts, nails, clips, and other fasteners known in the art. Preferably, the collar 34 includes at least two lighting elements 16 that are spaced a predetermined distance from each other. More preferably, the collar 34 includes four to twelve lighting elements 16 spaced at least six inches from each other. In this configuration, the light assembly 10 includes a plurality of lighting elements 16 disposed along the perimeter of the light shaft 26 and provides a renewable energy powered light source that can be used instead of, or in addition to, lights in a building powered by the electrical grid.

In yet another configuration, as shown in FIGS. 6 and 7, the light assembly 10 for a skylight 12 includes a plurality of housings 36, each housing 36 having a lighting element 16 within a lower portion 38 of the housing 36 which extends toward the ceiling 30 of a building and a solar panel 18 and rechargeable battery 20 in the upper portion 40 of the housing 36 extending through the roof 42 and outside of the building. Any suitable material can be used for housings 36, including but not limited to plastic and metal materials. The solar panel 18 is positioned outside of the building to collect light and generate power for the lighting elements 16. Each housing 36 is installed such that the lighting elements 16 circumscribe the skylight 12 as shown in FIG. 7. That is, the plurality of housings 36 is arranged about a perimeter of the skylight 12 wherein each housing 36 is spaced at a predetermined distance from another. Each lighting element 16 is connected to a solar panel 18 and a rechargeable battery 20 within the housing 36 to provide a solar powered light assembly.

The lighting elements 16 are preferably incandescent, fluorescent, halogen or light emitting diode (LED) lights. Since LED lights are energy efficient and long lasting, lighting elements 16 are more preferably LED lights. Further, the lighting elements 16 preferably provide a low level lighting that is dim enough to be left on at night, but that illuminates the surrounding area with enough light to allow an individual to view objects in the area. That is, light output of each lighting element 16 should be 100 lumens or less and more preferably, 25 lumens or less. It should be appreciated that although a skylight is shown in the Figures, the light assembly 10 can be similarly arranged around a window, or any type of roof aperture with a window, or similar opening in a building.

The lighting elements 16 are preferably powered by a renewable energy source. As shown in FIGS. 1-4, 8 and 10 the lighting elements 16 are connected, for example, to a solar power source 44 including the solar panel 18, the rechargeable battery 20, and the wires 46 connecting the solar panel 18 and rechargeable battery 20 to the lighting elements 16. The solar panel 18 comprises a plurality of electrically connected photovoltaic cells. Although one solar panel 18 is shown, it should be appreciated that a plurality of solar panels can be used. The solar panel 18 can be mounted anywhere on the building that receives sunlight, including the roof as shown in the Figures. In another configuration, the renewable energy source is wind power. As shown in FIGS. 5 and 9, the lighting elements 16 can be connected to a wind turbine 48 having a rechargeable battery (not shown) and by wires 46. Preferably, the wind turbine 48 is large enough to generate enough power to illuminate at least two lighting elements, which power may be stored in the rechargeable battery.

Each configuration can include a sensor 49 for detecting ambient light levels and activating the renewable energy powered lighting elements 16 when the ambient light level is below a desired ambient light level and deactivating the renewable energy powered lighting elements when the ambient light level is above a desired ambient light level. Each configuration can alternatively include a timer (not shown) that turns the lighting elements 16 on and off at designated times. Each configuration can also include a translucent cover (not shown) having a perimeter circumscribing the perimeter edge of the window and overlying the lighting elements 16. A plurality of translucent panels, each enclosing at least one lighting element 16 can be used instead.

Figure 9:
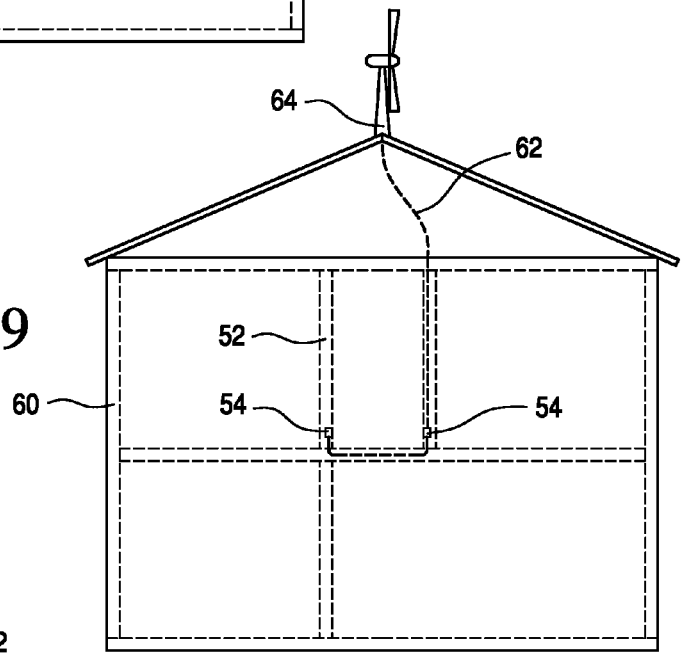
FIG. 9 is a view of a building having a wall mounted light assembly coupled to a wind turbine.
Figure 10:
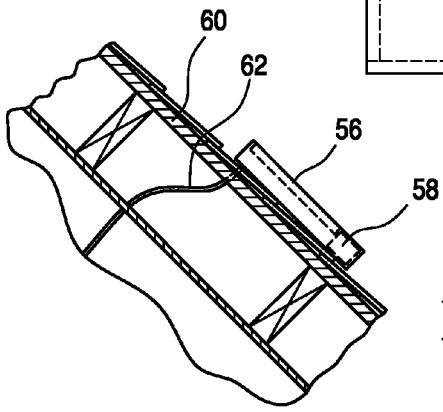
FIG. 10 is a partial cross sectional view of a solar panel and rechargeable battery mounted to a roof of a building.
Figure 11:
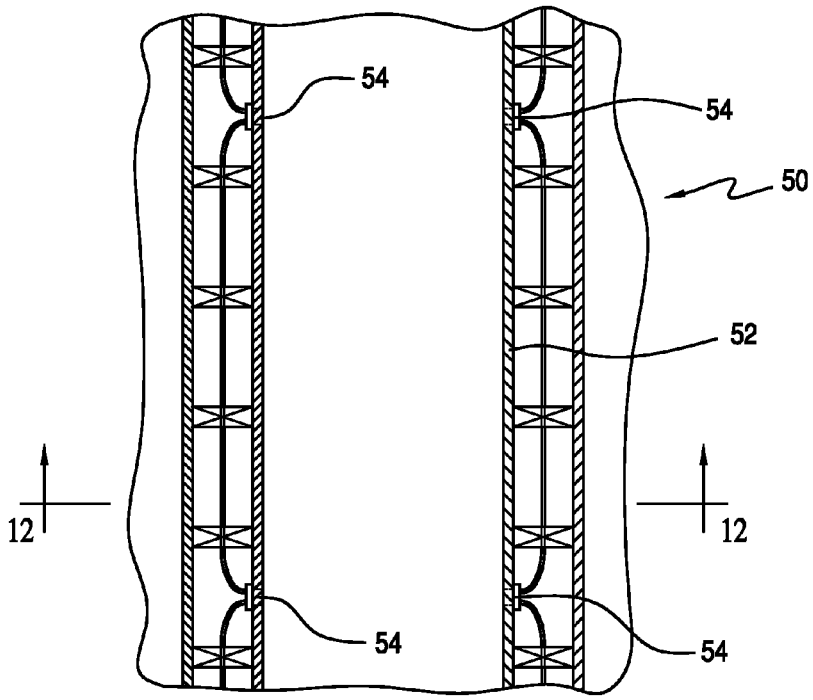
FIG. 11 is a cross-sectional view of a wall mounted light assembly.
Figure 12:
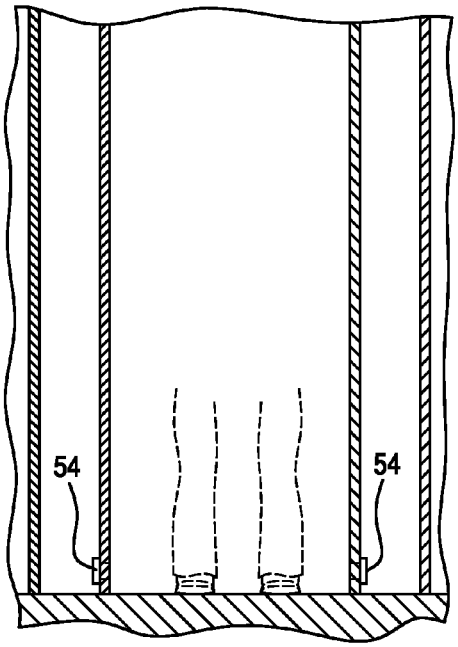
FIG. 12 is a cross-sectional view of a wall mounted low level light assembly showing a first position of the lighting elements.
Figure 13:
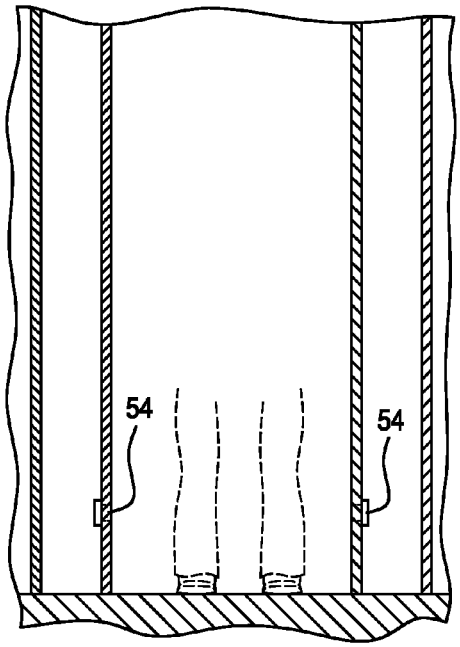
FIG. 13 is a cross-sectional view of a wall mounted low level light assembly showing a second position of the lighting elements.

Referring to the FIGS. 8-13, a renewably energy powered light assembly 50 for a wall 52 is shown, which includes a plurality of lighting elements 54, a renewable energy source, such as a solar panel 56 or a wind turbine 64, and a rechargeable battery 58. The solar panel 56 is externally mounted adjacent the building 60 for generating power for the plurality of renewable energy powered lighting elements 54. Wires 62 connect the lighting elements 54 to the solar panel 56 and the rechargeable battery 20 to provide a renewable energy source powered light assembly. Although four light elements 54 are shown in FIG. 11, it should be appreciated by those having ordinary skill in the art that the number of lighting elements 54 included in the light assembly 50 can be increased or decreased as necessary. That is, lighting elements 54 should be spaced at least 36 inches apart to provide enough light to dimly illuminate a hallway or other area. The light assembly 50, therefore, can be used as a nightlight. Preferably, the lighting elements 54 are each approximately 3 inches wide by 2.5 inches high and are disposed within the wall 52 between ankle height and knee height. The lighting elements 54 can be incandescent, fluorescent, halogen or light emitting diode (LED) lights. However, since LED lights are energy efficient and long lasting, lighting elements 54 are preferably LED lights. The light assembly 50 can be disposed on any story of a building and connected to the renewable energy source mounted adjacent the building. As shown in FIGS. 8 and 9, the renewable energy source can be generated from solar power as described above or wind power via a wind turbine 64 sized to generate enough power for at least two lighting elements 54.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes that come within the meaning and range of equivalency of the claims are therefore intended to be embraced therein.

The invention claimed is:

1. An off-grid solar powered light assembly for a window in a roof of a building comprising:

a plurality of housings insertable through the roof and arranged about a perimeter of the window, each housing having an upper portion disposed outside the building and a lower portion disposed inside the building;

a first solar powered lighting element disposed in the lower portion of each housing;

at least one solar panel array connected to each of the solar powered lighting elements and disposed on the upper portion of each of the housings disposed outside the building for collecting light and generating power for the solar powered lighting elements;

a plurality of rechargeable power sources each connected to the at least one solar panel array and the solar powered lighting element of each housing for storing the power generated by at least one solar panel array and powering the solar powered lighting element;

an electrical grid powered lighting element mounted in the interior of the building; and a second solar panel array connected to at least one of the rechargeable power sources, the second solar panel array located within the building and collecting light from the electrical grid powered lighting element.

2. The off-grid solar powered light assembly of claim 1 wherein the solar powered lighting elements circumscribe the window.

3. The off-grid solar powered light assembly of claim 1 wherein the solar powered lighting elements are spaced at a predetermined distance from each other.

4. The off-grid solar powered light assembly of claim 1 wherein each solar powered lighting element emits a low level of light.

5. The off-grid solar powered light assembly of claim 4, wherein each solar powered lighting element is a light emitting diode.

6. The off-grid solar powered light assembly of claim 1 wherein the window is a skylight.

7. An off-grid solar powered light assembly for a window comprising:

a housing, wherein the housing is an L-shaped plate having an upper portion and a lower portion;

a plurality of solar powered lighting elements disposed on the lower portion of the housing and circumscribing a perimeter of the window and spaced at a predetermined distance from each other;

at least one solar panel array coupled to the plurality of solar powered lighting elements for collecting light and generating power for the plurality of solar powered lighting elements;

a rechargeable power source coupled to the at least one solar panel array and the plurality of solar powered lighting elements for storing the power generated by the solar panel array and powering the plurality of solar powered lighting elements; and an electrical grid powered lighting element proximate the at least one solar panel array, the at least one solar panel array collecting light from the electrical grid powered lighting element and storing the power generated by the at least one solar panel array collecting light from the electrical grid powered lighting element by the rechargeable power source.

8. The off-grid solar powered light assembly of claim 7 wherein the housing is a collar.

9. The off-grid solar powered light assembly of claim 7 further comprising a sensor disposed in the housing and coupled to the plurality of solar powered lighting elements and the rechargeable power source therein for detecting an ambient light level and activating the solar powered lighting elements when the ambient light level is below a desired ambient light level.

10. The off-grid solar powered light assembly of claim 7 wherein the plurality of solar powered lighting elements provides a low light output level.

11. A solar powered light assembly for a house having a roof aperture with a window therein comprising:

a housing extending within the roof aperture from an interior of the house towards the exterior of the house, wherein the housing is an L-shaped plate having an upper portion and a lower portion;

a first solar panel array connected to the housing;

a first solar powered lighting element connected to housing and disposed on the lower portion;

a rechargeable power source connected to the solar panel array and the solar powered lighting element for storing the power generated by the solar panel array and powering the solar powered lighting element;

an electrical grid powered lighting element connected to the housing and located in an interior of the house; and a second solar panel array connected to the housing in the interior of the house and the rechargeable power source, the second solar panel array collecting light from the electrical grid powered lighting element, wherein the rechargeable power source stores the power generated by the second solar panel array for powering the solar powered lighting element.

12. The solar powered light assembly for a house of claim 11 wherein the housing is a collar insertable within a portion of the roof aperture and containing the first solar powered lighting element.

13. The solar powered light assembly of claim 11 further comprising a sensor disposed in the housing and coupled to the first solar powered lighting element the rechargeable power source therein for detecting an ambient light level and activating the solar powered lighting element when the ambient light level is below a desired ambient light level.

14. The solar powered light assembly of claim 11 wherein the first solar powered lighting element provides a low light output level.

15. An off-grid renewable energy powered light assembly for a window in a roof of a building comprising:

a housing extending within the roof aperture from an interior of the house towards the exterior of the house;

a plurality of renewable energy powered lighting elements disposed in the housing;

a first renewable energy source mounted on the building and connected to each of the renewable energy powered lighting elements;

a rechargeable power source connected to the renewable energy source and the plurality of renewable energy powered lighting elements for storing the power generated by the renewable energy source and powering the plurality of renewable energy powered lighting element;

an electrical grid powered lighting element mounted in the interior of the house; and a second renewable energy source connected to the housing and the rechargeable power source, the second renewable energy source collecting light from the electrical grid powered lighting element, wherein the rechargeable power source stores the power generated by the second renewable energy source for powering the renewable energy powered lighting element.

16. The off-grid renewable energy powered light assembly of claim 15 wherein the plurality of renewable energy lighting elements circumscribes the window.

17. The off-grid renewable energy powered light assembly of claim 15 wherein the renewable energy source is wind power.

18. The off-grid renewable energy powered light assembly of claim 15 wherein the renewable energy source is solar power.

19. The off-grid renewable energy powered light assembly of claim 15 wherein the plurality of renewable energy lighting elements emits a low level of light.

20. An off-grid renewable energy powered light assembly for illuminating an area from a floor of a building comprising:

a plurality of renewable energy powered lighting elements each disposed adjacent the floor of an interior of the building;

a first renewable energy source mounted on the building and coupled to the plurality of renewable energy powered lighting elements and externally mounted adjacent the building for generating power for the plurality of renewable energy powered lighting elements;

a rechargeable power source coupled to the renewable energy source and the plurality of renewable energy powered lighting elements for storing the power generated by the renewable energy source and powering the plurality of renewable energy lighting elements;

a second renewable energy source connected to the interior of the building; and an electrical grid powered lighting element proximate the second renewable energy source, the second renewable energy source collecting light from the electrical grid powered lighting element.

21. The off-grid renewable energy powered light assembly for illuminating an area from a floor of a building of claim 20 wherein the renewable energy source is at least one solar panel.

22. The off-grid renewable energy powered light assembly for illuminating an area from a floor of a building of claim 20 wherein the renewable energy source is a wind turbine.

23. The off-grid renewable energy powered light assembly for illuminating an area from a floor of a building of claim 20 wherein the plurality of renewable energy powered lighting elements are each disposed at least six inches from the floor.

* * * * *

UNITED STATES PATENT AND TRADEMARK OFFICE

CERTIFICATE OF CORRECTION

PATENT NO. : 8,696,152 B2
APPLICATION NO. : 12/729125
DATED : April 15, 2014
INVENTOR(S) : Cumberland et al.

It is certified that error appears in the above-identified patent and that said Letters Patent is hereby corrected as shown below:

Title Page, Item (75) Inventor is corrected to read:
-- Holly S. Cumberland, Malibu (CA);
Todd Cumberland, Malibu (CA) --.

Signed and Sealed this
Sixteenth Day of June, 2015

Michelle K. Lee

Michelle K. Lee
*Director of the United States Patent and Trademark Office*